United States Patent [19]

Ogawa

[11] 4,336,789

[45] Jun. 29, 1982

[54] COOKING GAS OVEN

[75] Inventor: Kazuo Ogawa, Nagoya, Japan

[73] Assignee: Rinnai Kabushiki Kaisha, Nagoya, Japan

[21] Appl. No.: 82,214

[22] Filed: Oct. 4, 1979

[30] Foreign Application Priority Data

Oct. 5, 1978 [JP] Japan ..... 53/136125

[51] Int. Cl.[3] ..... A21B 1/00

[52] U.S. Cl. ..... 126/21 A

[58] Field of Search ..... 126/21 A, 21 R, 273 R; 431/350

[56] References Cited

U.S. PATENT DOCUMENTS

| | | | |
|---|---|---|---|
| 2,670,394 | 2/1954 | West | 431/350 |
| 3,723,050 | 3/1973 | Stevens, Jr. et al. | 431/350 |
| 3,817,690 | 6/1974 | Bryce et al. | 431/350 |
| 3,831,579 | 8/1974 | Tamada et al. | 126/21 A |
| 3,991,737 | 11/1976 | Fabbro | 126/21 A |
| 4,029,463 | 6/1977 | Johansson et al. | 126/21 A |
| 4,109,636 | 8/1978 | Burge | 126/21 A |

*Primary Examiner*—Samuel Scott
*Assistant Examiner*—Wesley S. Hatliff, Jr.
*Attorney, Agent, or Firm*—Armstrong, Nikaido, Marmelstein & Kubovcik

[57] ABSTRACT

A cooking gas oven of the type with a heating housing having a door on its front and a combustion chamber of forcible exhaust type disposed below the heating housing. A burner is provided in an oven main body. There is formed in the combustion chamber, an intake passage for introducing the external air from an air intake opening in an outside surface of the combustion chamber, into a position of the burner. In the passage, there is a regulating plate for flowing the air over the burner at accelerated speed.

2 Claims, 3 Drawing Figures

COOKING GAS OVEN

FIELD OF THE INVENTION

The present invention relates to a cooking gas oven of such a type that there is provided below a heating housing containing in an oven body a combustion chamber having therein a burner.

PRIOR ART

In a conventional cooking gas oven of this type, there has been in the past such a type of arrangement that a combustion hot gas in the combustion chamber is forcibly discharged and is drawn into either the heating housing or a hot gas space surrounding the outer periphery of the heating housing. The interior of the heating housing is thereby heated directly or indirectly. With this arrangement, a combustion flame of the burner is liable to drift upwards and this involves such inconveniences that the flame touches the bottom surface of the heating housing. The bottom surface becomes thereby overheated and an unequally distributed temperature results. In addition a thermal deformation of the heating housing is liable to be brought about.

SUMMARY OF THE INVENTION

An object of this invention is to provide a cooking gas oven free from such inconveniences.

According to the present invention, there is provided a cooking gas oven with an oven main body 1, a heating housing 3 having a front opening and closing door 2, and a combustion chamber of a forcible exhaust type disposed below the heating housing 3 and 5 having therein a burner. In the combustion chamber 5, there is provided an air intake passage 7 for introducing the external air through an air intake opening 6 in an outside surface of the combustion chamber 5 into a position at which the foregoing burner 4 is disposed. In the passage 7 there is a regulating plate 8 for flowing the air over the burner 4 at accelerated speed.

DETAILED DESCRIPTION

Figure 1:
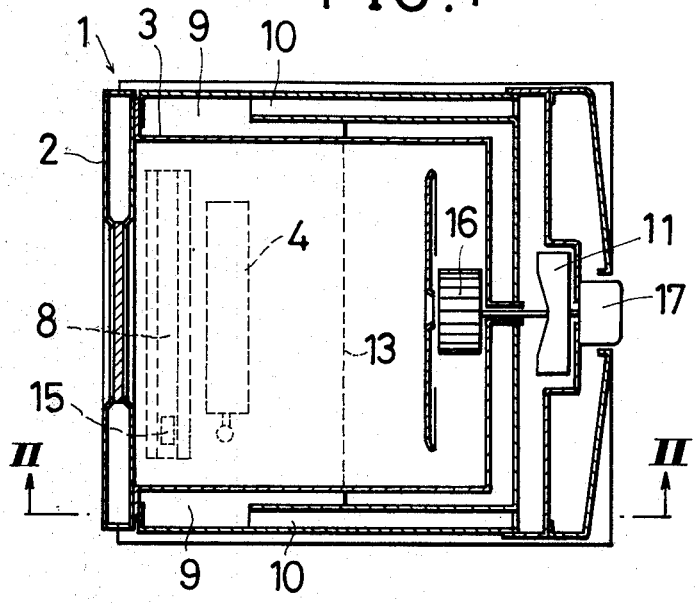
FIG. 1 is a sectional plan view showing one example of this invention.
Figure 2:
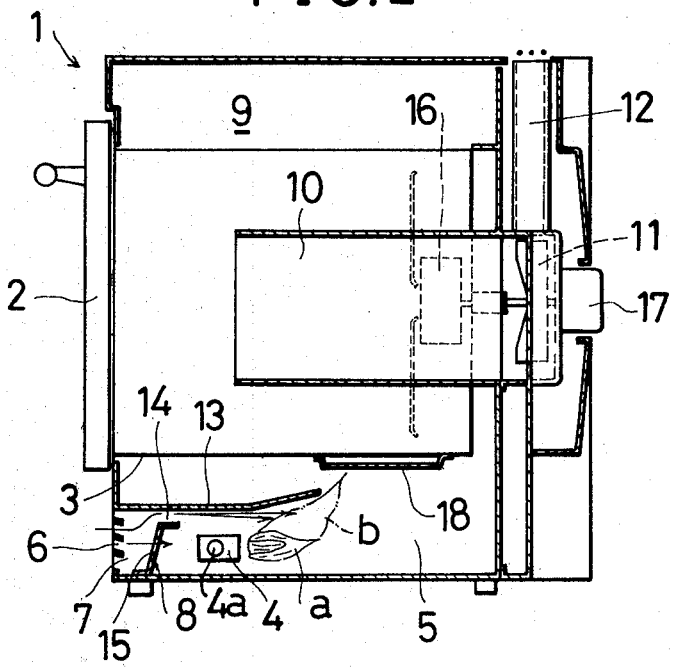
FIG. 2 is a sectional side view taken along the line II—II in FIG. 2.

Referring to the drawings, FIGS. 1 and 2 show one embodying example of this invention.

Numeral 1 denotes a oven main body, and, there are provided in the oven main body 1 a heating housing 3 having a front opening and closing door 2, and a combustion chamber of forcible exhaust type 5 disposed below the heating chamber 3 and having therein a burner 4. In the combustion chamber 5 there is provided an air intake passage 7 for introducing the external air from an air intake opening 6 made in the outside surface of the combustion chamber 5 and positioned at a place at which foregoing burner 4 is located. There is provided in the passage 7 a regulating plate 8 for flowing the air over the burner 4 at accelerated speed. The heating housing 3 is constructed to be of such a closed or indirect heated type, that outside the heating housing 3 there is provided within the main body 1 a hot gas space 9 which is in communication with the combustion chamber 5. The hot gas space 9 is in communication through exhaust ducts 10, 10 on the right and left sides thereof with an exhaust pipe 12 having therein an exhaust fan. Consequently, by driving the exhaust fan 11, a hot gas in the combustion chamber 5 is drawn out to flow into the hot gas space 9, so that indirect heating of the interior of the heating housing 3 from outside can be carried out.

The combustion chamber 5 is provided with a partition plate 13 extending over the burner 4, and thereby a space below the partition plate 13 is formed into the air intake passage 7 which is in communication with the intake opening 6 on the forward outside surface of the combustion chamber 5. In the air intake passage 7, there is provided the regulating plate 8 raised upwards in front of the burner 4, so that a throttel passage gap directed towards an upper space portion over the burner 4, is formed between the regulating plate 8 and the partition plate 13.

Referring to the drawings, numeral 15 denotes a hole arranged in the regulating plate 8 so as to face a nozzle 4*a* of the burner 4, and is used for drawing in primary air and for confirmation of a combustion condition. Numeral 16 denotes a stirring fan provided in the heating housing 3, numeral 17 denotes a driving motor for driving the stirring fan 16 and the exhaust fan 11, and numeral 18 denotes a heat insulating plate attached to the bottom surface of the heating housing 3.

Next, the operation of the foregoing gas oven of the present invention will be explained.

As the exhaust fan 11 is driven, the external air is drawn into the air intake passage 7, and the air is passed through the passage gap 14 formed by the regulating plate 8 and thereby is accelerated in its flow speed and is flown over the burner 4 in its accelerated speed condition. Consequently, such a combustion flame of the burner 4 that tends to drift upwards and be elongated as shown by b in FIG. 2, comes into contact with that air flow, so that mixing of the combustion gas and the air is accelerated and a complete combustion can be brought about. The combustion flame is shortened in length and an upward drifting thereof can be prevented, as shown by a in FIG. 2.

Accordingly, the heating housing 3 is not heated directly from its bottom surface by the combustion flame, and the heating chamber 3 is heated equally from the outside by the combustion hot gas flown in the hot gas space 9.

Figure 3:
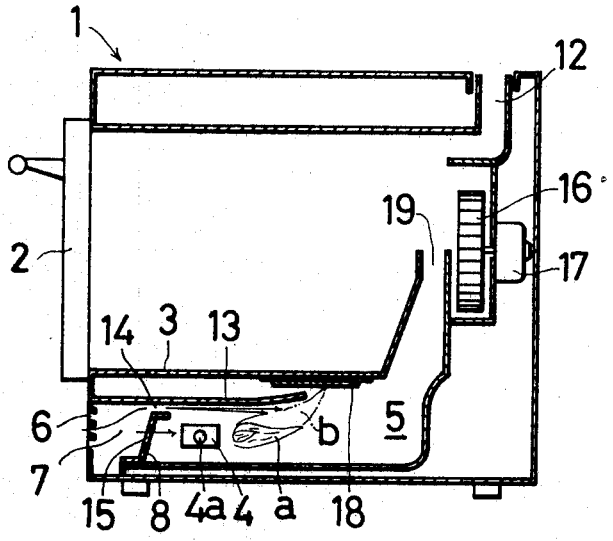
FIG. 3 is a sectional side view of another example thereof.

FIG. 3 shows another embodiment in which the combustion chamber 5 is opened, at a hot gas duct 19 extending upwards from a rear end portion thereof, to the center portion of the stirring fan 16 in the heating housing 3. In this manner, as the stirring fan 16 is driven, the combustion hot gas in the combustion chamber 5 is drawn by the fan 16 and is blown into the heating housing 3 from the periphery of the fan 16 and thereby a direct heating of the heating housing 3 can take place. In this case also, the regulating plate 8 is provided in almost the same manner as in the foregoing example and thereby an upward drifting of the combustion flame can be prevented.

Furthermore, in the foregoing two examples, it is so arranged that the air intake passage 7 is defined by the partition plate 13 interposed in the combustion chamber 5.

However, it can be considered that the partition plate 13 is not provided, and in this case the regulating plate 8 is so provided as to form the air passage gap 14 between the bottom of the heating housing 3 and the regulating plate 8, and thereby the air passage gap 14 can effect the same operation as in the above examples.

Thus, according to the present invention, there is provided in an air intake passage 7 of a combustion chamber 5, a regulating plate 8 for flowing the air over a burner 4 in its accelerated condition, so that an upward drifting of a combustion flame of the burner can be prevented, and the above-mentioned inconveniences of the conventional gas oven can be removed without fail. Accordingly, a large gap between the burner 4 and the heating housing 3 in order to prevent the combustion flame from touching the heating housing becomes unnecessary, so that an even itself can be made small in size.

What is claimed is:

1. A cooking gas oven comprising: an oven main body; a heating housing having a front opening and closing door; a combustion chamber of forcible exhaust type disposed below said heating housing; said combustion chamber having a burner, and an air intake passage for introducing external air through an air intake opening in an outside surface of said combustion chamber into a position at which said burner is located; the improvement comprising: a regulating plate in said passage reducing the air passageway and flowing air over the burner at an accelerated speed whereby the burner flame remains generally horizontal, away from any direct contact with said oven main body; a partition plate extending over said burner, a passage gap being formed between said partition plate and said regulating plate, so that air is introduced through said passage gap.

2. A cooking gas oven comprising: an oven main body; a heating housing having a front opening and closing door; a combustion chamber of forcible exhaust type disposed below said heating housing; said combustion chamber including a burner having a nozzle, and an air intake passage for introducing external air through an air intake opening in an outside surface of said combustion chamber into a position at which said burner is located; the improvement comprising: a regulating plate in said passage reducing the air passageway and flowing air over the burner at an accelerated speed whereby the burner flame remains generally horizontal, away from any direct contact with said oven main body and said regulating plate has a hole facing a nozzle of said burner, whereby said hole introduces primary air and confirms a combustion condition.

* * * * *